US009613570B2

(12) United States Patent
Tseng et al.

(10) Patent No.: US 9,613,570 B2
(45) Date of Patent: Apr. 4, 2017

(54) DISPLAY DEVICE, OLED PIXEL DRIVING CIRCUIT AND DRIVING METHOD THEREFOR

(71) Applicant: EverDisplay Optronics (Shanghai) Limited, Shanghai (CN)

(72) Inventors: Ying-Hsiang Tseng, Shanghai (CN); Lina Xiao, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 0 days.

(21) Appl. No.: 15/090,126

(22) Filed: Apr. 4, 2016

(65) Prior Publication Data

US 2016/0217741 A1 Jul. 28, 2016

Related U.S. Application Data

(62) Division of application No. 14/945,535, filed on Nov. 19, 2015.

(30) Foreign Application Priority Data

Nov. 25, 2014 (CN) ..... 2014 1 0692048

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/3258* (2013.01); *G09G 3/3266* (2013.01); *G09G 3/3275* (2013.01); *G09G 5/10* (2013.01); *G09G 2300/043* (2013.01); *G09G 2300/0809* (2013.01); *G09G 2300/0819* (2013.01); *G09G 2300/0842* (2013.01); *G09G 2300/0861* (2013.01); *G09G 2300/0876* (2013.01); *G09G 2310/0216* (2013.01);
(Continued)

(58) Field of Classification Search
CPC .. G09G 3/3233; G09G 3/3258; G09G 3/3291; G09G 2320/062; G09G 2320/06
See application file for complete search history.

(56) References Cited

U.S. PATENT DOCUMENTS 6,522,314 B1 * 2/2003 Tomio ..... G09G 3/20 345/211
9,081,453 B2 * 7/2015 Bulea ..... G06F 3/044
(Continued)

*Primary Examiner* — Ricardo L Osorio
(74) *Attorney, Agent, or Firm* — Yunling Ren

(57) ABSTRACT

The present disclosure provides a display device, an OLED pixel driving circuit and a driving method therefore. The OLED pixel driving circuit includes: an electroluminescent element, a switching unit, a storage unit, a compensation unit, a driving transistor, a reset unit and a partition unit; wherein, the switching unit is connected with a data signal and is connected with the storage unit; the compensation unit is connected with the storage unit; the storage unit is connected with a gate electrode of the driving transistor; a source electrode of the driving transistor is connected with a driving voltage, a drain electrode thereof is connected with the compensation unit; the partition unit is connected with the drain electrode and is connected with the electroluminescent element; the reset unit is connected with a reset signal and is connected with the gate electrode.

8 Claims, 10 Drawing Sheets

(51) Int. Cl.
*G09G 3/3275* (2016.01)
*G09G 5/10* (2006.01)
*G09G 3/3266* (2016.01)

(52) U.S. Cl.
CPC . *G09G 2310/0251* (2013.01); *G09G 2310/08* (2013.01); *G09G 2320/0233* (2013.01); *G09G 2320/043* (2013.01)

(56) References Cited

U.S. PATENT DOCUMENTS

| | | | | |
|---|---|---|---|---|
| 9,081,457 | B2 * | 7/2015 | Solven | G06F 3/044 |
| 2006/0033698 | A1 * | 2/2006 | Chen | G09G 3/3648 345/102 |
| 2011/0115764 | A1 * | 5/2011 | Chung | G09G 3/3233 345/205 |
| 2011/0164016 | A1 * | 7/2011 | Kang | G09G 3/3233 345/211 |
| 2014/0168180 | A1 * | 6/2014 | Kim | H05B 33/0896 345/205 |
| 2014/0192883 | A1 * | 7/2014 | Seregin | H04N 19/52 375/240.16 |
| 2014/0254669 | A1 * | 9/2014 | Rapaka | H04N 19/50 375/240.12 |
| 2015/0201204 | A1 * | 7/2015 | Chen | H04N 19/33 375/240.02 |
| 2015/0243226 | A1 * | 8/2015 | Kumeta | G09G 3/3233 345/207 |
| 2015/0382023 | A1 * | 12/2015 | Ramasubramonian | H04N 19/30 375/240.25 |
| 2016/0027382 | A1 * | 1/2016 | Chaji | G09G 3/006 345/212 |
| 2016/0042692 | A1 * | 2/2016 | Ota | G09G 3/3233 345/215 |

* cited by examiner

DISPLAY DEVICE, OLED PIXEL DRIVING CIRCUIT AND DRIVING METHOD THEREFOR

CROSS-REFERENCE TO RELATED APPLICATIONS

The present application is a Divisional application of U.S. patent application Ser. No. 14/945,535 filed Nov. 19, 2015, which claims priority under 35 U.S.C. §119 to Chinese Patent Application No. 201410692048.3, filed Nov. 25, 2014, the entire contents of which are incorporated herein by reference.

TECHNICAL FIELD

The present disclosure relates to the field of display technology, and more particularly, to an OLED pixel driving circuit, a driving method for the OLED pixel driving circuit, and a display device including the OLED pixel driving circuit.

BACKGROUND

Compared with the liquid crystal display panel in the conventional technology, the OLED (Organic Light Emitting Diode) display panel has characteristics such as faster response speed, better color purity and brightness, higher contrast, wider visual angle and so on. Thus, the display technology developers are paying increasingly widespread attention to the OLED display panel.

A pixel unit in the OLED display panel mainly includes an organic light emitting diode and a pixel unit driving circuit for driving the organic light emitting diode. The traditional 2T1C pixel unit driving circuit is shown in FIG. 1A or FIG. 1B: including a first transistor T1, a driving transistor DTFT and a storage capacitor Cst. The first transistor T1 is controlled by a first scan signal Sn output from a scan line, so as to control the writing of a data signal Data of a data line. The driving transistor DTFT is used for controlling the organic light emitting diode OLED to emit light. The storage capacitor Cst is used to provide a holding voltage to the gate electrode of the driving transistor DTFT.

The organic light emitting diode OLED can emit light while it is driven by the driving current produced when the driving transistor DTFT is operating in saturation state, wherein the driving current $I_{OLED}$ can be expressed as:

$$I_{OLED} = \frac{1}{2}\mu_n \cdot C_{OX} \cdot \frac{W}{L} \cdot (Vdd - Vdata - Vth)^2$$

where, $\mu_n \cdot C_{OX} \cdot W/L$ is a constant related to process and driving design, for example, $\mu_n$ is the carrier mobility, $C_{OX}$ is the gate oxide layer capacitance, W/L is width to length ratio of the transistor; Vdata is the voltage of the data signal Data, Vdd is the driving voltage of the driving transistor DTFT and is shared by all the pixel units, Vth is the threshold voltage of the driving transistor DTFT.

However, due to technical limitations, the uniformity of the threshold voltage Vth is usually poor, and drifting of the threshold voltage Vth will occur in use. From the above equation it can be known that, if different pixel units have different Vth, then there is a difference in the driving current, causing non-uniform of the display brightness; if the threshold voltage Vth of the driving transistor drifts over time, it may result in different currents over time, influencing the display effect. Further, since there is a certain impedance on the driving voltage line inevitably, so there is a certain voltage drop (i.e., IR Drop) when the driving voltage Vdd of the driving transistor transmits from one end of the OLED display panel to the other end, which will result in the display brightness non-uniform across the OLED display panel, influencing the user's experience.

SUMMARY

The present disclosure aims to provide an OLED pixel driving circuit, a driving method for the OLED pixel driving circuit, and a display device including the OLED pixel driving circuit, so as to the overcome one or more problems caused by the limitation and defect of the related technology at a certain degree.

The other characteristics and advantages of the present disclosure will become apparent from the following description, or may be learned by the practice of the present disclosure.

According to the first aspect of the present disclosure, there is provided an OLED pixel driving circuit, including: an electroluminescent element, a switching unit, a storage unit, a compensation unit, a driving transistor, a reset unit and a partition unit; wherein:

a first end of the switching unit is connected with a data signal, a second end of the switching unit is connected with a first end of the storage unit; the switching unit is used to control the data signal to be written into the storage unit;

a first end of the compensation unit is connected with a second end of the storage unit; the compensation unit is used to prestore a threshold voltage of the driving transistor into the storage unit;

the second end of the storage unit is connected with a gate electrode of the driving transistor; the storage unit is used to store a written voltage signal and provide it to the gate electrode of the driving transistor;

a source electrode of the driving transistor is connected with a driving voltage, a drain electrode of the driving transistor is connected with a second end of the compensation unit;

a first end of the partition unit is connected with the drain electrode of the driving transistor, a second end of the partition unit is connected with the electroluminescent element; the partition unit is used to partition an electronic connection between the driving transistor and the electroluminescent element; and a first end of the reset unit is connected with a reset signal, a second end of the reset unit is connected with the gate electrode of the driving transistor; the reset unit is used to reset a level of the gate electrode of the driving transistor.

In an exemplary embodiment of the present disclosure, the electroluminescent element is an organic light emitting diode, the switching unit is a first transistor, the compensation unit is a second transistor, the partition unit is a third transistor, the reset unit is a fourth transistor, and the storage unit is a storage capacitor;

a gate electrode of the first transistor is connected with a first scan signal, a source electrode of the first transistor is connected with the data signal, and a drain electrode of the first transistor is connected with a first end of the storage capacitor;

a gate electrode of the second transistor is connected with the first scan signal, a source electrode of the second transistor is connected with the drain electrode of the driving transistor, and a drain electrode of the second transistor is connected with a second end of the storage capacitor;

the second end of the storage capacitor is connected with the gate electrode of the driving transistor;

a gate electrode of the third transistor is connected with an enable signal, a source electrode of the third transistor is connected with the drain electrode of the driving transistor, and a drain electrode of the third transistor is connected with the organic light emitting diode; and a gate electrode and a source electrode of the fourth transistor are connected with the reset signal, and a drain electrode of the fourth transistor is connected with the gate electrode of the driving transistor.

In an exemplary embodiment of the present disclosure, further including a fifth transistor; a gate electrode of the fifth transistor is connected with the enable signal, a source electrode of the fifth transistor is connected with a reference voltage, and a drain electrode of the fifth transistor is connected with the first end of the storage capacitor.

In an exemplary embodiment of the present disclosure, the reset signal is a second scan signal; the first scan signal is provided by a scan line, and the second scan signal is provided by a preceding scan line ahead of the scan line.

In an exemplary embodiment of the present disclosure, all the transistors are P-type thin film transistors; the source electrode of the driving transistor is connected with a high level driving voltage, a drain electrode of the third transistor is connected with an anode of the organic light emitting diode, and a cathode of the organic light emitting diode is connected with a low level voltage.

In an exemplary embodiment of the present disclosure, all the transistors are N-type thin film transistors; the source electrode of the driving transistor is connected with a low level driving voltage, the drain electrode of the third transistor is connected with a cathode of the organic light emitting diode, and an anode of the organic light emitting diode is connected with a high level voltage.

According to the second aspect of the present disclosure, there is provided a driving method for an OLED pixel driving circuit, the OLED pixel driving circuit including: an electroluminescent element, a switching unit, a storage unit, a compensation unit, a driving transistor, a reset unit and a partition unit; a first end of the switching unit is connected with a data signal, a second end of the switching unit is connected with a first end of the storage unit; a first end of the compensation unit is connected with a second end of the storage unit; the second end of the storage unit is connected with a gate electrode of the driving transistor; a source electrode of the driving transistor is connected with a driving voltage, and a drain electrode of the driving transistor is connected with a second end of the compensation unit; a first end of the partition unit is connected with the drain electrode of the driving transistor, a second end of the partition unit is connected with the electroluminescent element; and a first end of the reset unit is connected with a reset signal, a second end of the reset unit is connected with the gate electrode of the driving transistor; the driving method includes:

turning on the reset unit and turning off the switching unit, the compensation unit and the partition unit, making the reset signal applied to the gate electrode of the driving transistor, resetting a level of the gate electrode of the driving transistor;

turning on the switching unit and the compensation unit and turning off the partition unit and the reset unit, making the data signal and a threshold voltage of the driving transistor written into the storage unit; and turning on the partition unit and turning off the switching unit, the compensation unit and the reset unit, turning on the driving transistor by a voltage signal stored in the storage unit, making the driving transistor output a driving current so as to drive, via the partition unit, the electroluminescent element to emit light.

In an exemplary embodiment of the present disclosure, the OLED pixel driving circuit further includes a voltage stabilizing unit; the driving method further includes:

during the electroluminescent element emitting light, turning on the voltage stabilizing unit, so as to stabilize a level of the first end of the storage capacitor by the reference voltage.

According to the third aspect of the present disclosure, there is provided an OLED pixel driving circuit, including: an electroluminescent element, a switching unit, a storage unit, a compensation unit, a driving transistor, a reset unit and a partition unit; wherein, the switching unit is configured to receive a data signal and control the data signal to be written into the storage unit;

the compensation unit is configured to prestore a threshold voltage of the driving transistor into the storage unit;

the storage unit is configured to store a written voltage signal and to provide it to a gate electrode of the driving transistor;

the driving transistor is configured to receive a driving voltage;

the partition unit is configured to partition an electronic connection between the driving transistor and the electroluminescent element; and the reset unit is configured to reset a level of the gate electrode of the driving transistor.

According to the fourth aspect of the present disclosure, there is provided a display device, including any one of the OLED pixel driving circuits above.

In an OLED pixel driving circuit provided by an exemplary embodiment of the present disclosure, firstly, the reset unit resets level of the gate electrode of the driving transistor, thus eliminating the influence of the last frame residual voltage signal; next, at the time of writing data to the storage unit, the partition unit blocks the electronic connection of the drain electrode of the driving transistor and the electroluminescent element, and the storage unit prestores a threshold voltage of the driving transistor and a data signal, thus compensating for the threshold voltage drifting effectively, ensuring the uniformity and stability of the driving current, and in turn making the brightness of the OLED display panel more uniform.

BRIEF DESCRIPTION OF THE DRAWINGS

The exemplary embodiments of the disclosure will be described in detail with reference to the accompanying drawings, through which the above and other features and advantages of the disclosure will become more apparent.

LISTING OF REFERENCE NUMERALS

Figure 1A:
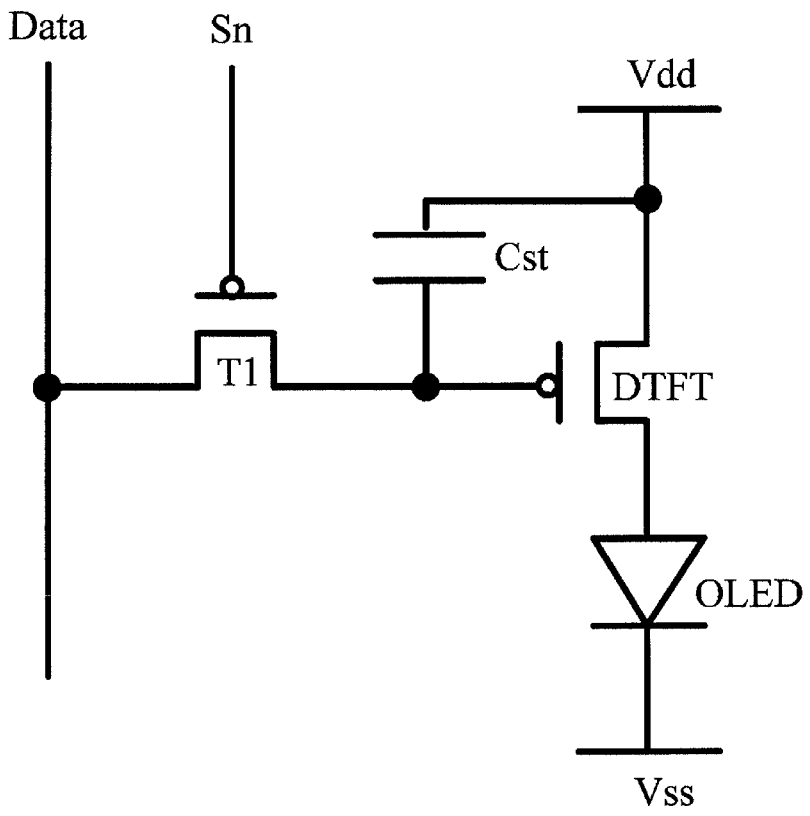
Fig. 1A (Prior Art)
FIG. 1A and FIG. 1B are schematic diagrams of an OLED pixel driving circuit in the related art.
Figure 1B:
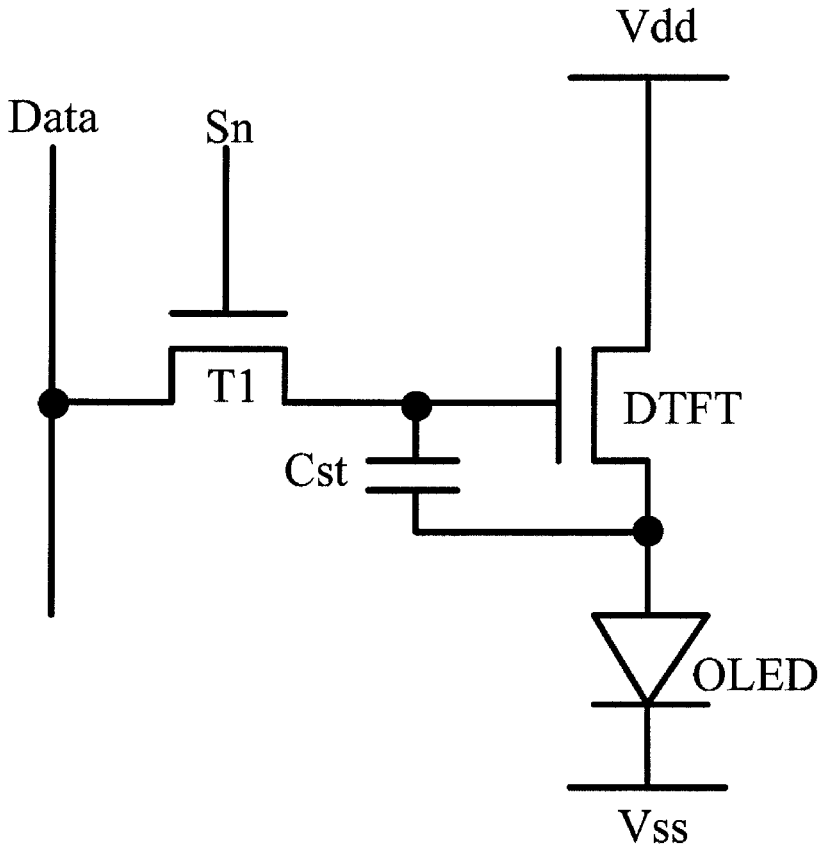
Fig. 1B (Prior Art)

11 switching unit
12 compensation unit
13 partition unit
14 reset unit
15 storage unit
16 electroluminescent element
DTFT driving transistor
T1 first transistor
T2 second transistor
T3 third transistor
T4 fourth transistor
T5 fifth transistor
Cst storage capacitor
OLED organic light emitting diode
Vdd driving voltage
Vss low level voltage
Data data signal
Sn first scan signal
Sn-1 second scan signal
En enable signal
Vref reference voltage
Re reset signal

DESCRIPTION OF THE EMBODIMENTS

The exemplary embodiments of the present disclosure will now be described more fully with reference to the accompanying drawings. However, the exemplary embodiments can be implemented in various forms and should not be understood as being limited to the embodiments set forth herein; instead, these embodiments are provided so that this disclosure will be thorough and complete, and the conception of exemplary embodiments will be fully conveyed to those skilled in the art. In the drawings, the thicknesses of the regions and layers are exaggerated for clarity. In the drawings, the same reference numerals denote the same or similar structures, thus their detailed description will be omitted.

In addition, the described features, structures, or characteristics may be combined in one or more embodiments in any suitable manner. In the following description, numerous specific details are provided so as to allow a full understanding of the embodiments of the present disclosure. However, those skilled in the art will recognize that the technical solutions of the present disclosure may be practiced without one or more of the specific details, or other methods, components, materials and so on may be used. In other cases, well-known structures, materials or operations are not shown or described in detail to avoid obscuring various aspects of the present disclosure.

Figure 2:
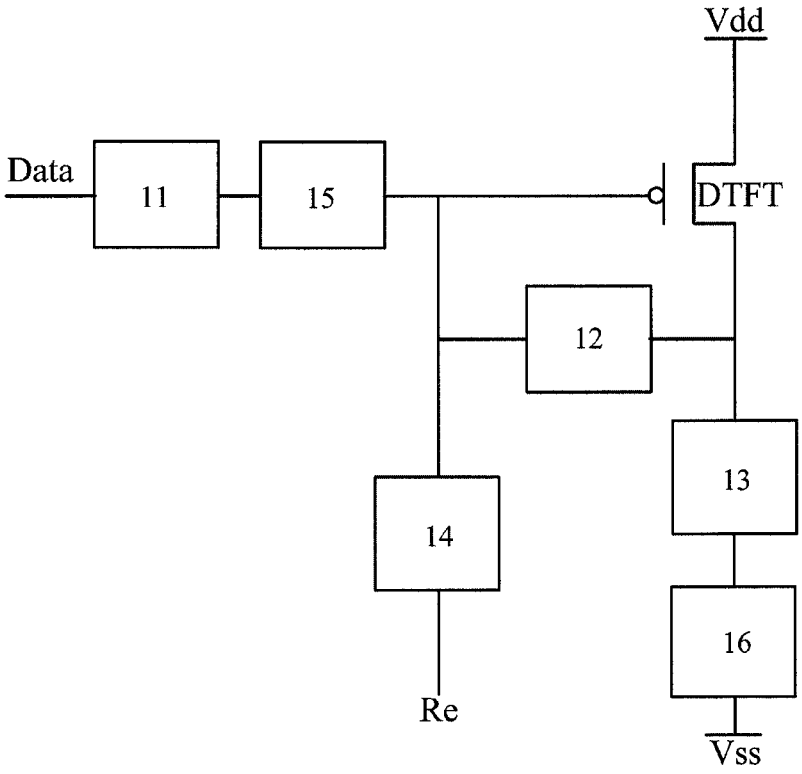
FIG. 2 is a schematic diagram of module connection of an OLED pixel driving circuit in an exemplary embodiment of the present disclosure.

An OLED pixel driving circuit is provided firstly in the present exemplary embodiment. As shown in FIG. 2, the OLED pixel driving circuit mainly includes an electroluminescent element 16, a switching unit 11, a storage unit 15, a compensation unit 12, a driving transistor DTFT, a reset unit 14, a partition unit 13, and so on.

A first end of the switching unit 11 is connected with a data line, thus receiving a data signal Data; a second end of the switching unit 11 is connected with a first end of the storage unit 15; the switching unit 11 is used to control the data signal Data to be written into the storage unit 15. A first end of the compensation unit 12 is connected with a second end of the storage unit 15; the compensation unit 12 is used to prestore a threshold voltage of the driving transistor DTFT into the storage unit 15. The second end of the storage unit 15 is connected with a gate electrode of the driving transistor DTFT; the storage unit 15 is used to store a written voltage signal and provide it to the gate electrode of the driving transistor DTFT. A source electrode of the driving transistor DTFT is connected with a driving power source, thus receiving a driving voltage Vdd; a drain electrode of the driving transistor DTFT is connected with a second end of the compensation unit 12. A first end of the partition unit 13 is connected with the drain electrode of the driving transistor DTFT, and a second end of the partition unit 13 is connected with the electroluminescent element 16; the partition unit 13 is used to partition the electronic connection between the driving transistor DTFT and the electroluminescent element 16. A first end of the reset unit 14 is connected with a reset signal Re, and a second end of the reset unit 14 is connected with the gate electrode of the driving transistor DTFT; the reset unit 14 is used to reset a level of the gate electrode of the driving transistor DTFT.

The driving method for the OLED pixel driving circuit will be described below, which may include:

Reset stage: to control the reset unit 14 to be turned on and control the switching unit 11, the compensation unit 12 and the partition unit 13 to be turned off; the reset signal Re is applied to the gate electrode of the driving transistor DTFT by the reset unit 14, so as to reset a level of the gate electrode of the driving transistor DTFT, and eliminate the influence of the residual voltage signal of the last frame;

Charging stage: to control the switching unit 11 and the compensation unit 12 to be turned on and control the partition unit 13 and the reset unit 14 to be turned off; the data signal and the threshold voltage of the driving transistor DTFT are written into the storage unit 15; and Display stage: to control the partition unit 13 to be turned on and control the switching unit 11, the compensation unit 12 and the reset unit 14 to be turned off; to drive the electroluminescent element 16 to emit light by a voltage signal stored in the storage unit 15.

In the above OLED pixel driving circuit, firstly, the level of the gate electrode of the driving transistor DTFT is reset by the reset unit 14, thus eliminating the influence of the residual voltage signal of the last frame; next, at the time of writing data into the storage unit 15, the electronic connection between the drain electrode of the driving transistor DTFT and the electroluminescent element 16 is blocked by the partition unit 13, and threshold voltage of the driving transistor DTFT and data signal Data are prestored by the storage unit 15, thus compensating for the threshold voltage drifting effectively, ensuring the uniformity and stability of the driving current, and in turn making the brightness of the OLED display panel more uniform.

In addition, the above OLED pixel driving circuit may further include a voltage stabilizing unit; a first end of the voltage stabilizing unit is connected with a reference voltage, a second end of the voltage stabilizing unit is connected with the first end of the storage unit; the reference voltage signal may be provided to the storage unit by arranging the voltage stabilizing unit, so as to stabilize a level of the first end of the storage unit at the display stage, thus stabilizing the level of the gate electrode of the driving transistor, and preventing the level from generating fluctuation due to interference of noises.

Figure 3:
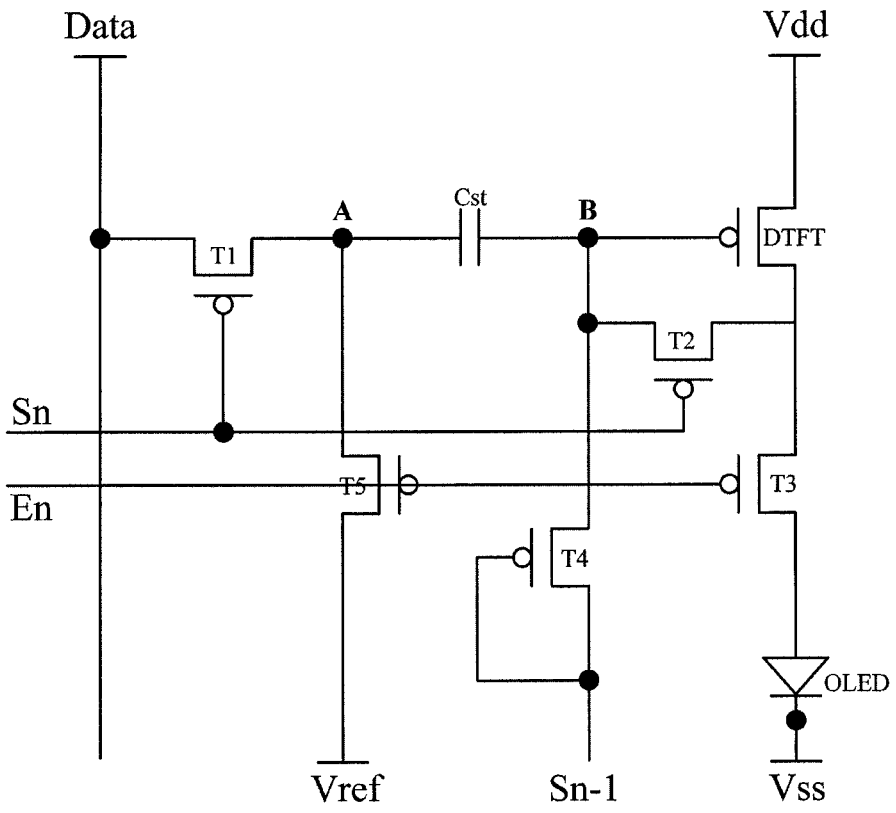
FIG. 3 is a schematic diagram of an OLED pixel driving circuit in an exemplary embodiment of the present disclosure.

Referring to FIG. 3, it is a specific implementation of the above OLED pixel driving circuit. The electroluminescent element 16 may be an organic light emitting diode OLED, the switching unit 11 may be a first transistor T1, the compensation unit 12 may be a second transistor T2, the partition unit 13 may be a third transistor T3, the reset unit 14 may be a fourth transistor T4, and the storage unit 15 may be a storage capacitor Cst.

In the present exemplary embodiment, a gate electrode of the first transistor T1 is connected with a first scan line, a source electrode thereof is connected with the data signal, and a drain electrode thereof is connected with a first end of the storage capacitor Cst. The first transistor T1 may be turned on or turned off under the control of a first scan signal Sn output from the first scan line. A gate electrode of the second transistor T2 is also connected with the first scan line, a source electrode thereof is connected with the drain electrode of the driving transistor DTFT, and a drain electrode thereof is connected with a second end of the storage capacitor Cst. The second transistor T2 may be turned on or turned off under the control of the first scan signal Sn output from the first scan line. The second end of the storage capacitor Cst is connected with the gate electrode of the driving transistor DTFT. A gate electrode of the third transistor T3 is connected with an enable signal En, a source electrode thereof is connected with the drain electrode of the driving transistor DTFT, and a drain electrode thereof is connected with the organic light emitting diode OLED. The third transistor T3 may be turned on or turned off under the control of the enable signal En. A gate electrode and a source electrode of the fourth transistor T4 are connected with the reset signal Re, and a drain electrode thereof is connected with the gate electrode of the driving transistor DTFT. The fourth transistor T4 may be turned on or turned off under the control of the reset signal Re.

In an exemplary embodiment of the present disclosure, the above reset signal Re may be a second scan signal Sn-1; the second scan signal Sn-1 is provided by a second scan line, the second scan line is a preceding scan line ahead of the first scan line, which may reduce the amount of the total control signals and control lines.

Continuing to refer to FIG. 3, besides the above devices, the OLED pixel driving circuit in the present exemplary embodiment may further include a fifth transistor T5. A gate electrode of the fifth transistor T5 is connected with the enable signal En, a source electrode thereof is connected with a reference voltage Vref, and a drain electrode thereof is connected with the first end of the storage capacitor Cst. The fifth transistor T5 may be turned on or turned off under the control of the enable signal En. The reference voltage signal may be provided to the storage capacitor Cst by arranging the fifth transistor T5, so as to stabilize a level of the first end of the storage capacitor Cst at the display stage, thus stabilizing a level of the gate electrode of the driving transistor DTFT, and preventing the level from generating fluctuation due to interference of noises.

The additional advantage of the pixel driving circuit in the present embodiment is the use of a single channel type of transistors, which are all P-type thin film transistors. Using only P-type thin film transistors further has the following advantages: for example, a strong suppression against noise; for example, because of low-level turning on, it is easier to achieve a low level in the charging management; for example, N-type thin film transistor is vulnerable to be affected by Ground Bounce, while P-type thin film transistor will only be affected by IR Drop of driving voltage line, and generally the impact of IR Drop is easier to be eliminated; for example, P-type thin film transistor's manufacturing process is simple, and the price is relatively low; for example, the stability of P-type thin film transistor is better, and so on. Therefore, using only P-type thin film transistors may not only reduce the complexity of the manufacturing process and the production cost, but also contribute to improve quality of the product. As shown in FIG. 3, when all the transistors are P-type thin film transistors, the source electrode of the driving transistor DTFT is connected with a high level driving voltage Vdd, the drain electrode of the third transistor T3 is connected with an anode of the organic light emitting diode OLED, and a cathode of the organic light emitting diode OLED is connected with a low level voltage Vss.

Those skilled in the art may easily obtain that the pixel driving circuit provided by the present disclosure may be easily changed to a pixel driving circuit with only N-type thin film transistors. As compared with the circuit connection structure of P-type thin film transistors, the differences mainly lie in: when all the transistors are N-type thin film transistors, the source electrode of the driving transistor is connected with a low level driving voltage, the drain electrode of the third transistor is connected with the cathode of the organic light emitting diode, and the anode of the organic light emitting diode is connected with a high level voltage. Also, the pixel driving circuit provided by the present disclosure may be easily changed to CMOS (Complementary Metal Oxide Semiconductor) circuit and the like, which is not limited to the OLED pixel driving circuit provided in the present embodiment, and will not be repeatedly illustrated herein.

Figure 4:
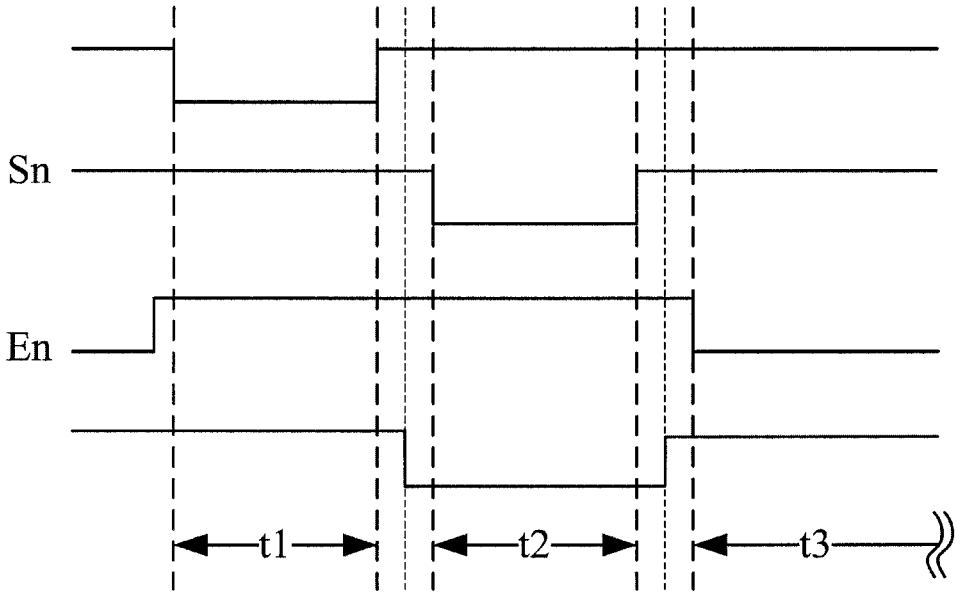
FIG. 4 is a schematic diagram of driving timing of the OLED pixel driving circuit in FIG. 3.

Hereinafter, the driving method for the OLED pixel driving circuit in FIG. 3 is illustrated in combination with the driving timing diagram as shown in FIG. 4. Referring to FIG. 4, the driving method mainly includes a reset timing segment t1, a charging timing segment t2 and a display timing segment t3. The equivalent circuit diagrams at each timing segments are shown in FIGS. 5-7.

Figure 5:
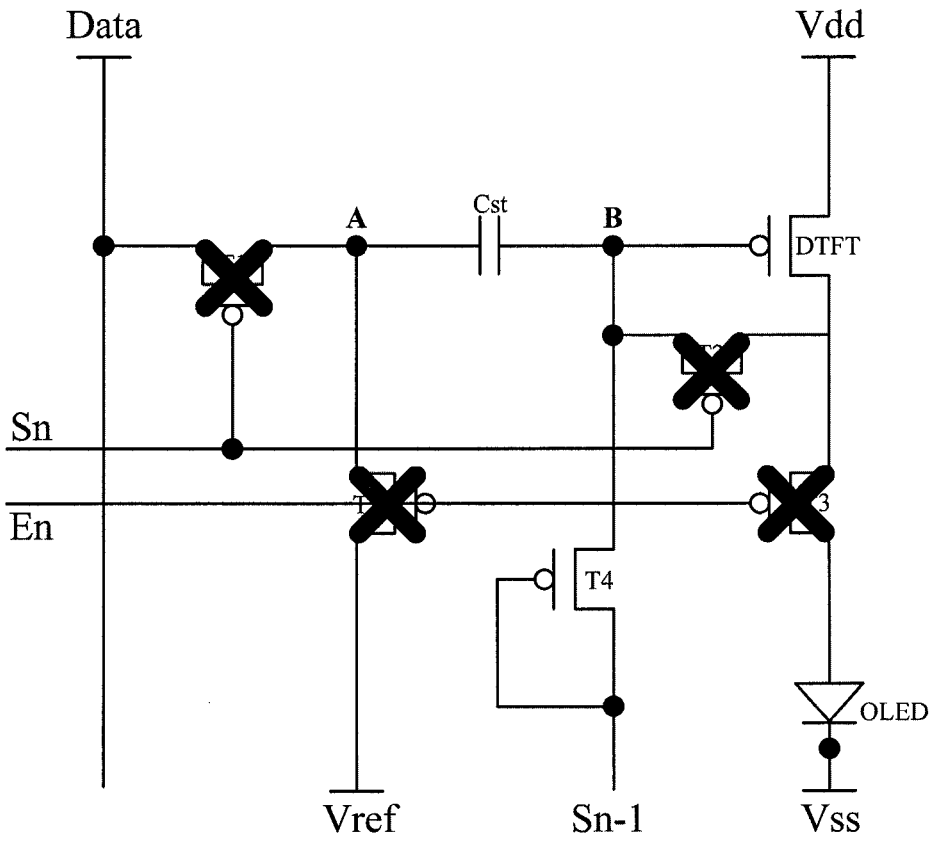
FIG. 5 is an equivalent circuit diagram of the OLED pixel driving circuit in FIG. 3 at reset timing segment.

As shown in FIG. 4 and FIG. 5, in the reset timing segment t1, the second scan signal Sn-1 is at low level, thus controlling the fourth transistor T4 to be turned on; the first scan signal Sn is at high level, thus controlling the first transistor T1 and the second transistor T2 to be turned off; the enable signal En is also at high level, thus controlling the third transistor T3 and the fifth transistor T5 to be turned off. In this timing segment, the reset signal (i.e., the second scan signal Sn-1) is applied to the gate electrode of the driving transistor DTFT through the fourth transistor T4, thus resetting the level of the gate electrode of the driving transistor DTFT, eliminating the influence of the residual voltage signal of the last frame.

Figure 6:
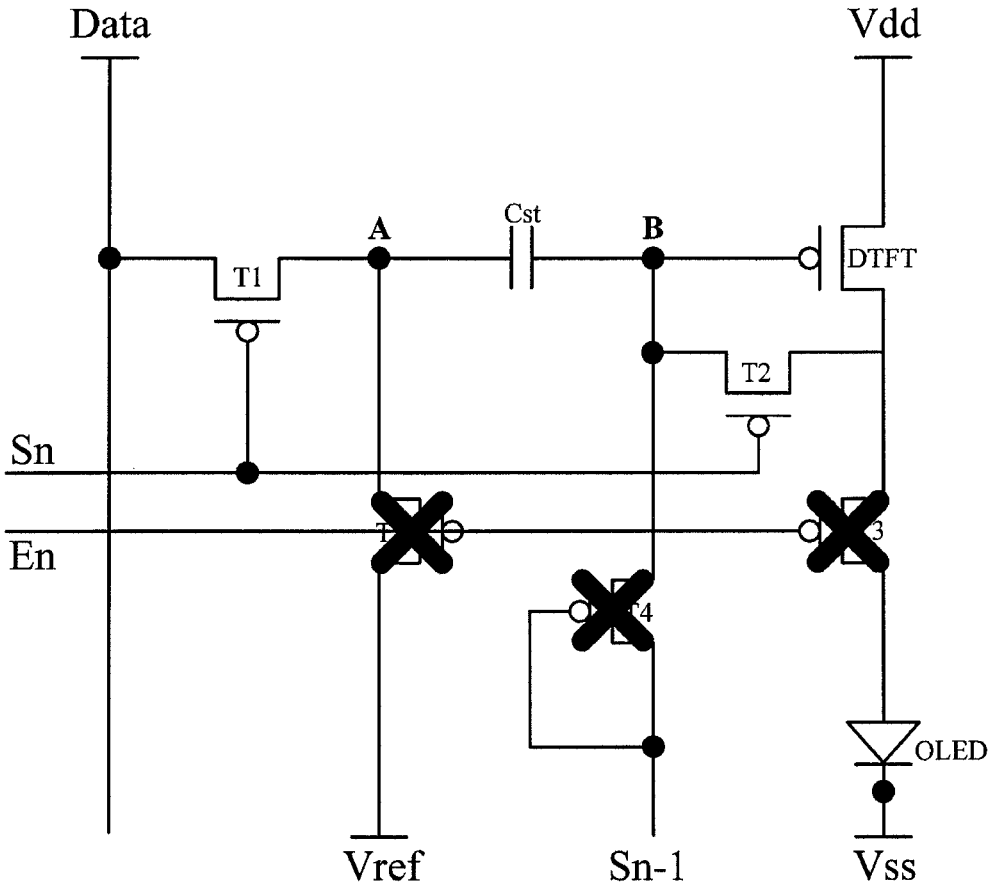
FIG. 6 is an equivalent circuit diagram of the OLED pixel driving circuit in FIG. 3 at charging timing segment.

As shown in FIG. 4 and FIG. 6, in the charging timing segment t2, the first scan signal Sn is at low level, thus controlling the first transistor T1 and the second transistor T2 to be turned on, thereby the data signal Data is written into the storage capacitor Cst; at this time, voltage at Point A in FIG. 6 is data signal voltage Vdata. The enable signal En is at high level, thus controlling the third transistor T3 and the fifth transistor T5 to be turned off; the second scan signal Sn-1 is also at high level, thus controlling the fourth transistor T4 to be turned off. Because the second transistor T2 is turned on, making the driving transistor DTFT form a diode connection, and ensuring that the driving transistor DTFT operates in a current saturation region, therefore, the driving power source charges the storage capacitor Cst by the stable driving voltage Vdd provided through the driving transistor DTFT, until the voltage of Point B in FIG. 6 rises to Vdd+Vth (Vth is the threshold voltage of the driving transistor DTFT); at this time, the driving transistor DTFT is turned off, and the voltage across the storage capacitor Cst is Vdd+Vth−Vdata.

Figure 7:
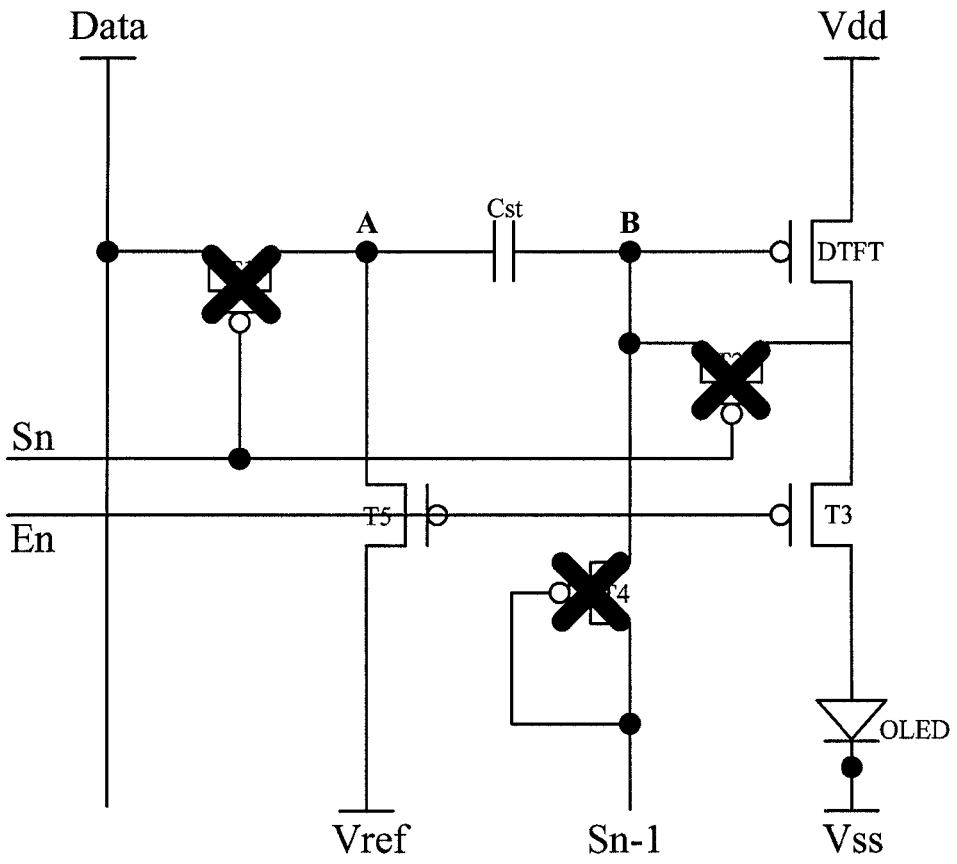
FIG. 7 is an equivalent circuit diagram of the OLED pixel driving circuit in FIG. 3 at display timing segment.

As shown in FIG. 4 and FIG. 7, in the display timing segment t3, the enable signal En is at low level, controlling the third transistor T3 and the fifth transistor T5 to be turned on; the first scan signal Sn is at high level, controlling the first transistor T1 and the second transistor T2 to be turned off; the reset signal Re is also at high level, controlling the fourth transistor T4 to be turned off. In this timing segment, the reference voltage Vref is written into the storage capacitor Cst through the third transistor T3, so the voltage of the first end of the storage capacitor Cst (i.e., the voltage at Point A in FIG. 7) equals to the reference voltage Vref. Because the gate electrode of the driving transistor DTFT is hung in the air, the level of the gate electrode of the driving transistor DTFT also jumps to be:

$$Vg=Vdd+Vth-V\text{data}+V\text{ref}$$

The gate-source voltage of the driving transistor DTFT is:

$$V_{gs}=V_g-V_{gs}=(Vdd+Vth+V\text{ref}-V\text{data})-Vdd=V\text{ref}+Vth-V\text{data}$$

At this time, the driving transistor DTFT is in saturation state, which provides stable driving current for the organic light emitting diode OLED; the driving current of the organic light emitting diode OLED is:

$$I_{oled}=\frac{1}{2}\mu_n\cdot C_{OX}\cdot\frac{W}{L}\cdot(V_{sg}-Vth)^2=\frac{1}{2}\mu_n\cdot C_{OX}\cdot\frac{W}{L}\cdot(Vref+Vth-Vdata-Vth)^2=\frac{1}{2}\mu_n\cdot C_{OX}\cdot\frac{W}{L}\cdot(Vref-Vdata)^2$$

where, $\mu_n\cdot C_{OX}\cdot W/L$ is a constant related to process and driving design. At last, the driving current drives the organic light emitting diode OLED to emit light through the third transistor T3.

It can be seen that in the present exemplary embodiment, there is no relationship between the driving current and the threshold voltage Vth of the driving transistor DTFT, so the threshold voltage drifting of the driving transistor DTFT will not affect the current of its drain electrode (i.e., the driving current $I_{oled}$ of the pixel circuit). In addition, it can be seen that in the present exemplary embodiment, there is also no relationship between the driving current and the driving voltage Vdd of the driving transistor DTFT, so the voltage drop of the driving voltage Vdd (i.e., IR Drop) will not affect the driving current $I_{oled}$ of the pixel circuit either. In conclusion, the present exemplary embodiment compensates for the threshold voltage drifting effectively, eliminating the influence of IR Drop on the driving current, ensuring the uniformity and stability of the driving current, and thus making the brightness of the OLED display panel more uniform.

Figure 8A:
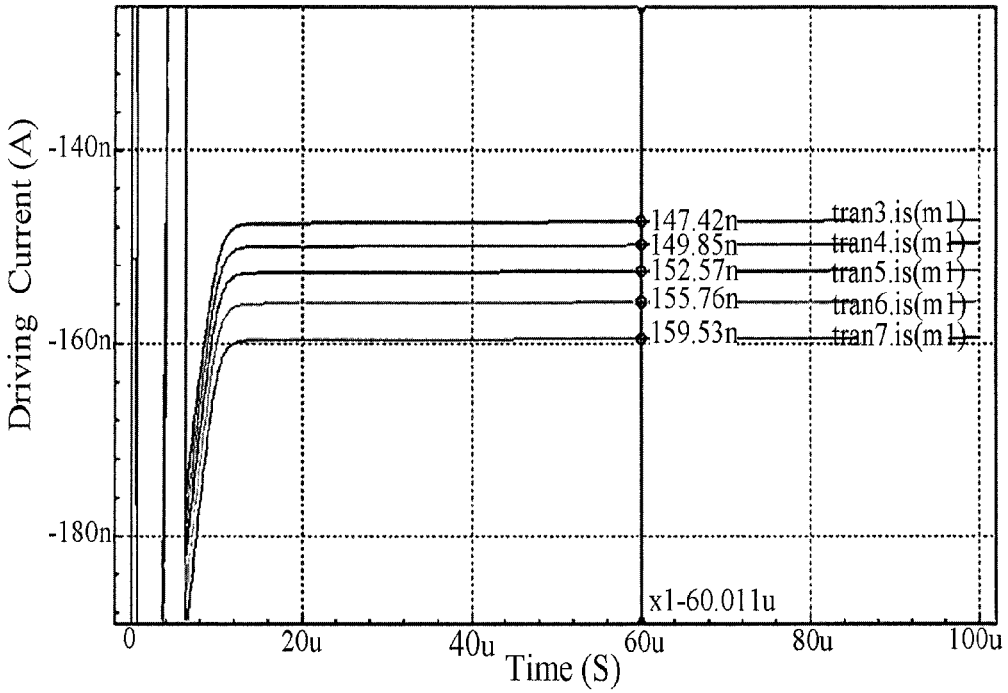
FIG. 8A and FIG. 8B are schematic diagrams of driving current simulation result of an OLED pixel driving circuit in an exemplary embodiment of the present disclosure.
Figure 8B:
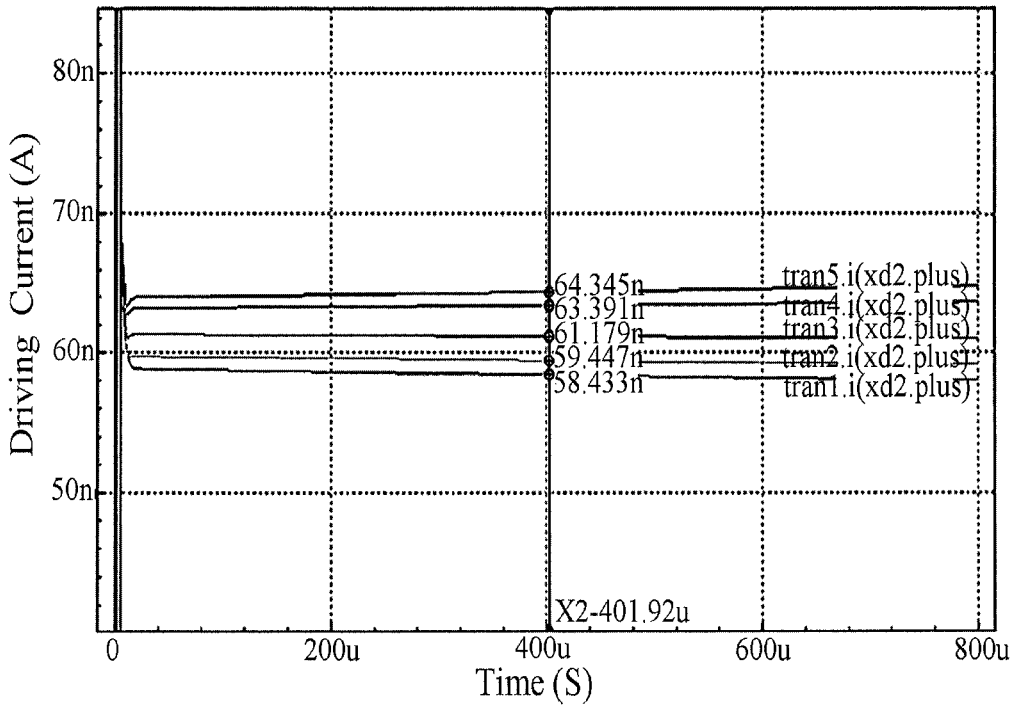

In addition, the inventor simulated the OLED pixel driving circuit of the present exemplary embodiment. As shown in FIG. 8A, it is the simulation result under the simulation condition of Vth±1V. It can be seen that, although the threshold voltage Vth of the driving transistor DTFT fluctuates, it does not have much influence on the driving current $I_{oled}$. As shown in FIG. 8B, it is the simulation result under the simulation condition of Vdd±1V. It can be seen that, although the driving voltage Vdd of the driving transistor DTFT fluctuates, it does not have much influence on the driving current $I_{oled}$ either.

Further, the present exemplary embodiment also provides a display device. The display device includes the aforesaid OLED pixel driving circuit. Specifically, the display device may include a plurality of pixel arrays, each pixel corresponding to any one of the OLED pixel driving circuits in the present exemplary embodiment. The OLED pixel driving circuit compensates for the threshold voltage drifting of the driving transistor, and eliminates the influence of IR Drop on the driving current, thus making the organic light emitting diode OLED to be displayed stably, improving the uniformity of the display brightness of the display device, which may thereby improve the display quality greatly.

The present disclosure has been described with reference to the above related exemplary embodiments, while the above embodiments are only examples of implementing the present disclosure. It should be pointed out that the disclosed embodiments do not limit the scope of the present disclosure. Instead, all changes or modifications without departing from the spirit and scope of the present disclosure will fall within the patent protection scope of the present disclosure.

What is claimed is:

1. An OLED pixel driving circuit, comprising: an electroluminescent element, a switching unit, a storage unit, a compensation unit, a driving transistor, a reset unit and a partition unit; wherein, the switching unit is configured to receive a data signal and control the data signal to be written into the storage unit;

the compensation unit is configured to prestore a threshold voltage of the driving transistor into the storage unit;

the storage unit is configured to store a written voltage signal and to provide it to a gate electrode of the driving transistor;

the driving transistor is configured to receive a driving voltage;

the partition unit is configured to partition an electronic connection between the driving transistor and the electroluminescent element; and the reset unit is configured to reset a level of the gate electrode of the driving transistor, wherein a first end and a control end of the reset unit are configured to receive a reset signal, a second end of the reset unit is connected with the gate electrode of the driving transistor.

2. The OLED pixel driving circuit according to claim 1, wherein a first end of the switching unit is configured to receive a data signal, and a second end of the switching unit is connected with a first end of the storage unit.

3. The OLED pixel driving circuit according to claim 2, wherein a first end of the compensation unit is connected with a second end of the storage unit.

4. The OLED pixel driving circuit according to claim 3, wherein the second end of the storage unit is connected with a gate electrode of the driving transistor.

5. The OLED pixel driving circuit according to claim 4, wherein a source electrode of the driving transistor is configured to receive the driving voltage, and a drain electrode of the driving transistor is connected with a second end of the compensation unit.

6. The OLED pixel driving circuit according to claim 5, wherein a first end of the partition unit is connected with the drain electrode of the driving transistor, and a second end of the partition unit is connected with the electroluminescent element.

7. The OLED pixel driving circuit according to claim 1, further comprising a voltage stabilizing unit, wherein the voltage stabilizing unit is used to stabilize a level of the first end of the storage unit by a reference voltage.

8. The OLED pixel driving circuit according to claim 7, wherein the voltage stabilizing unit comprises a first end configured to receive the reference voltage, and a second end connected with the first end of the storage unit.

* * * * *